US011828061B1

(12) United States Patent
Johnson

(10) Patent No.: US 11,828,061 B1
(45) Date of Patent: Nov. 28, 2023

(54) MOBILE ACOUSTICAL PANEL

(71) Applicant: L.J. Avalon, LLC., Tampa, FL (US)

(72) Inventor: Lahnie Johnson, Tampa, FL (US)

(73) Assignee: LJ Avalon LLC, Tampa, FL (US)

( * ) Notice: Subject to any disclaimer, the term of this patent is extended or adjusted under 35 U.S.C. 154(b) by 465 days.

(21) Appl. No.: 16/712,041

(22) Filed: Dec. 12, 2019

Related U.S. Application Data

(63) Continuation-in-part of application No. 15/620,944, filed on Jun. 13, 2017, now Pat. No. 10,526,782, and a continuation-in-part of application No. 15/338,240, filed on Oct. 28, 2016, now Pat. No. 10,482,864.

(60) Provisional application No. 62/351,221, filed on Jun. 16, 2016, provisional application No. 62/248,894, filed on Oct. 30, 2015.

(51) Int. Cl.
*E04B 1/82* (2006.01)
*G10K 11/162* (2006.01)

(52) U.S. Cl.
CPC ..... *E04B 1/8227* (2013.01); *G10K 11/162* (2013.01); *E04B 2001/8263* (2013.01)

(58) Field of Classification Search
CPC ..... E04B 1/8227; E04B 2001/8263; E04B 1/8409; E04B 1/86; G10K 11/162
See application file for complete search history.

(56) References Cited

U.S. PATENT DOCUMENTS 3,017,969 A * 1/1962 Nielsen ..... F16B 5/0685 52/270
3,232,370 A * 2/1966 Jaffe ..... G10K 11/20 181/30
3,630,309 A * 12/1971 Wenger ..... E04B 1/8236 160/351
3,674,081 A * 7/1972 List ..... E06B 9/063 160/161
5,403,979 A * 4/1995 Rogers ..... G10K 11/20 181/287
5,651,405 A * 7/1997 Boeddeker ..... E04B 1/8236 52/6
6,009,930 A * 1/2000 Jantschek ..... E04B 2/7431 160/352
6,085,861 A * 7/2000 Jines ..... E04B 1/8236 52/6
6,598,649 B1 * 7/2003 Moore ..... E04B 2/7431 160/351
7,213,632 B1 * 5/2007 Goldstein ..... E04B 2/7429 160/234
7,584,776 B2 * 9/2009 Hardt, II ..... E04B 2/7427 160/135
7,735,537 B2 * 6/2010 Hardt, II ..... E04B 2/7431 160/135

(Continued)

FOREIGN PATENT DOCUMENTS

FR 2516123 A1 * 5/1983

*Primary Examiner* — Jeremy A Luks
(74) *Attorney, Agent, or Firm* — Frijouf, Rust & Pyle P.A.

(57) ABSTRACT

A moveable acoustical panel is disclosed for location on a surface comprising a frame having a lower support supporting an upper horizontal support by a first and a second vertical support. A first and second pair of support leg extends angularly from said first end of said frame with first and second plurality of rolling members secure thereto for enabling said frame to be moved along the surface. A flexible acoustical blocking material for blocking acoustical sound is secured to the supports.

13 Claims, 13 Drawing Sheets

(56) References Cited

U.S. PATENT DOCUMENTS

| | | | | |
|---|---|---|---|---|
| 8,136,626 | B1 * | 3/2012 | Aliev | E04H 15/14 181/208 |
| 8,893,762 | B2 * | 11/2014 | Ryan | E04B 2/7425 160/228 |
| 10,526,782 | B1 * | 1/2020 | Johnson | E04B 2/7405 |
| 2008/0040982 | A1 * | 2/2008 | Durand | A47B 9/14 52/239 |
| 2010/0051211 | A1 * | 3/2010 | Chen | E04B 2/7427 160/135 |
| 2011/0107700 | A1 * | 5/2011 | Keene | B32B 5/26 181/294 |
| 2012/0152468 | A1 * | 6/2012 | Melhart | G10K 11/20 160/368.1 |
| 2014/0262603 | A1 * | 9/2014 | Johnson | E01F 8/0017 181/211 |

* cited by examiner

*-14dB @ 40-50Hz = >60% noise reduction to the human ear

*-8.5dB @ 60Hz = aprox 45% noise reduction to the human ear

SAA = 0.07
NRC = 0.05

MOBILE ACOUSTICAL PANEL

CROSS-REFERENCE TO RELATED APPLICATIONS

This application is continuation in part of U.S. patent application Ser. No. 15/620,944 filed Jun. 13, 2017. U.S. patent application Ser. No. 15/620,944 filed Jun. 13, 2017 claims benefit of U.S. Patent Provisional application No. 62/351,221 filed Jun. 16, 2016.

This application claims benefit of U.S. patent application Ser. No. 15/338,240 filed Oct. 28, 2016. U.S. patent application Ser. No. 15/338,240 filed Oct. 28, 2016 claims benefit of U.S. Patent Provisional application No. 62/248,894 filed Oct. 30, 2015.

All subject matter set forth in provisional application Ser. No. 15/620,944 filed Jun. 13, 2017 and U.S. Patent Provisional application No. 62/351,221 filed Jun. 16, 2016 and U.S. patent application Ser. No. 15/338,240 filed Oct. 28, 2016 and U.S. Patent Provisional application No. 62/248,894 filed Oct. 30, 2015 is hereby incorporated by reference into the present application as if fully set forth herein.

BACKGROUND OF THE INVENTION

Field of the Invention

This invention relates to sound control and more particularly to a mobile acoustical panel for movement upon a horizontal surface.

Description of the Related Art

The prior art has known various types of devices and methods for reducing the level of sound within an environment. The various types of devices and methods of the prior art for reducing the level of sound within an environment included a diverse and variety of apparatuses and methods adapted for many as specific applications and uses.

One particular type of device for reducing the level of sound within an environment comprises the use of sound reducing panels and/or sound absorbing devices. Various types of sound reducing panels and sound absorbing devices have been incorporated by the prior art to reduce the level of sound and/or to selectively reduce or inhibit reflection of sound from reflective surfaces within an environment.

In some instances, the apparatuses and methods for reducing the level of sound within an environment selectively reduced the level of sound within an environment. Many of the apparatuses and methods for reducing the level of sound within an environment were specifically designed for providing enhancements for improving the acoustics within the environment. Sound reducing panels and sound absorbing devices have been employed in very large rooms such as auditoriums as well as smaller rooms such as recording studios, home theaters and the like.

Other apparatuses and methods for reducing the level of sound within an environment of the prior art reduce the overall level of acoustic noise and/or sound and/or noise within the environment. In many cases, sound absorbing apparatuses and methods were used to reduce the sound of operating machinery as well as being used for reducing the transmission of sound and/or noise between the adjacent walls of a building.

The following U.S. Patents are representative of the attempts of the prior art to provide apparatuses and devices for reducing sound within an environment.

U.S. Pat. No. 2,495,636 to O. R. Hoeltzel et al. discloses a unit comprising a layer of loosely matted mass of fibrous material. A substantially impervious preformed and film of thermoplastic synthetic resin material is integralized with the fibers in one face of the loosely matted material. A fabric covering on the other face of the loosely matted layer is enfolded and is secured about the edges of the mass and the film. The mass, film and fabric are in the form of the sound proof flexible panel adapted to cover and soundproof a section of a wall.

U.S. Pat. No. 2,497,912 to W. M. Rees discloses an acoustic construction for the walls and ceilings of an enclosure comprising a sound absorbing layer overlying the wall and formed by a plurality of rectangles or tiles of fibrous material arranged in a plane. The edge of each of the tiles is contiguous to and slightly spaced from the edges of adjoining tiles. A renewable facing for the sound absorbing layer includes a plurality of thin sheets of porous material individual to the tiles. Each of the sheets having tabs at its edges integral with the sheets and resiliently held in place between adjacent edges of the tiles to hold the sheets in place over the face of the tiles.

U.S. Pat. No. 2,553,363 to C. C. Droeger discloses a non-combustible wall or ceiling of a plurality of parallel, latterly spaced, non-combustible primary furrings anchored thereon. Sound absorbent pads are arranged between adjacent pairs of furrings. A plurality of spaced, non-combustible secondary furrings extend extended transversely across the primary furrings and are secured thereto. Each of the secondary furrings comprise a portion lying in a plane parallel with the wall or ceiling and bridging between primary furrings and are provided with a multiplicity of perforations adapted to threadably receive threaded shanks of screws. A multi-perforate finish sheaths overlies the aforesaid parts.

U.S. Pat. No. 2,694,025 to G. Slayter et al. discloses a structural board comprising a core of glass fibers bounded into a porous self-sufficient layer. A layer of substantially inorganic cementitious material is integrated with at least one of the faces of the core. The cementitious layer is formed of a composition consisting essentially of an amide-aldehyde resin selected from the group consisting of urea formaldehyde and melamine formaldehyde and gypsum cement.

U.S. Pat. No. 2,923,372 to M. Maccaferri discloses an all plastic acoustic tile formed of a molded plastic material comprising a plate-like body having a rearwardly extending edge flange thereabout integral therewith. The body is formed to provide the front side thereof as a flat, planar face and having a multiplicity of apertures therethrough from the front face to and opening through the rear side all the body. Sound wave dampening tubes are molded integrally with the body projecting rearwardly from the rear side thereof. Each of the dampening tubes has a passage therethrough opening at the rear end thereof. Each of the dampening tubes is located on the rear side of the body in position with a body aperture opening into and forming the inlet to the passage of the dampening tube. The body has the rear side thereof formed with an annular recess therein about each of the dampening tubes providing a reduced thickness base portion of the body with which the tube is integrally joined.

U.S. Pat. No. 3,136,397 to O. C. Eckel discloses an assembly with two angular adjoining walls and a ceiling. The assembly comprises a plurality of panels with a first of the panels extending along the ceiling from the first wall. A second of the panels extends along the first wall below the ceiling panel. A Z-shaped retainer embodying one angular portion is attached to the first wall. Another angular portion extends laterally away from the wall indirectly below the first ceiling panel and above the second panel. And a third angular portion extends downwardly away from the ceiling panel. The ceiling first panel rests on the other angular portion of the retainer.

U.S. Pat. No. 3,949,827 to Witherspoon discloses an acoustical panel assembly having improved structural, decorative and acoustical properties. The panel assembly includes a perimeter frame. A thin septum member is supported in the center of the frame. A fibrous glass layer is positioned adjacent each side of the septum member. A molded, semi-rigid, fibrous glass diffuser member is positioned adjacent each of the fibrous glass layers. The assembly includes means for joining adjacent panel assemblies and, in one embodiment, an outer decorative fabric layer is positioned adjacent each of the outer surfaces of the diffuser members.

U.S. Pat. No. 3,967,693 to Okawa discloses a means and method for diminishing energy of sound. A corrugated cover having holes therethrough is mounted on a wall by ribs and an edge plate. The wall and edge plate together with the ribs and corrugated cover form a plurality of chambers, each cooperating with a plurality of the holes for diminishing the energy of impinging sound waves.

United States Patent; U.S. Pat. No. 4,113,053 to Matsumoto et al. discloses a sound absorbing body which can effectively be utilized as an exterior sound absorbing wall or an interior wall of a house. The sound absorbing body comprises a number of sound absorbing cavities inclined at an angle alpha which is smaller than 80 degrees with respect to a transverse horizontal sectional plane of the body. The sound absorbing cavities being opened at the sound incident surface.

U.S. Pat. No. 4,160,491 to Matsumoto et al. discloses a perlite sound absorbing plate and a sound insulating wall constructed by arranging a number of the plates side by side and by assembling together into one integral body. The plate is composed of a mixture including 1,000 cubic centimeters by bulk volume of formed perlite particles each having a diameter of 0.1 to 7.0 millimeters 100 to 140 grams of cement, liquid rubber latex containing 5 to 20 grams of solid ingredients and a suitable amount of water and produced by press molding with a compression ratio of 1.10 to 1.30. The wall is constructed by assembling a number of the plates each provided with a side groove with the aid of supporting columns and reinforcing plates, each having a ridge adapted to be engaged with the side groove of the plate.

U.S. Pat. No. 4,207,964 to Taguchi discloses a sound absorbing and diffusing unit provided for assembling an acoustic screen which can be placed or hung in front of a wall inside an acoustic room for improving a sound-effect therein. These units are detachably joined together with each other so that they may be easily separated and assembled again to form an acoustic screen having another shape or construction to adjust or modulate a sound-effect. A sound absorbing porous panel having a desired picture or pattern can be easily hung against a wall. The decorative panel can be reversely hung on the wall to provide another interior ornamentation. Accordingly, an acoustically correct room and a desired ornamentation on a wall inside the acoustic room can be easily obtained and changed without providing a rigid reverberating surface of the room.

U.S. Pat. No. 4,248,325 to Georgopoulos discloses an improved sound absorptive tackable space dividing wall panel or similar article in which a wire mesh screen is disposed within the sound absorptive material a distance from the tackable surface less than the length of the tack pin, thereby providing additional support for the tackable load without appreciably reducing the sound absorptive characteristics of the panel.

U.S. Pat. No. 4,306,631 to Reusser discloses a noise barrier or other type wall or building assembly including a plurality of spans each extending between spaced apart posts and having top and bottom girts affixed to the posts and in turn supporting a plurality or series of vertically disposed panels. Unique mating interlock elements integrally formed along both lateral edges of the wall or building exterior panels allow the sequential interconnection of all panels in a series by means of a rotating displacement of the individual panels to yield multilateral interlocking of the panels. The panel faces are configured to provide shadow texture, while masking of the posts and top girts in a free-standing type wall is obtained by a split cover assembly and split cap trim, respectively.

U.S. Pat. No. 4,402,384 to Smith et al. discloses a sound barrier system particularly suited for out-of-doors, ground-mounted installations, such as for a highway noise barrier comprising a vertical wall composed of successive individual wall sections arranged with immediately adjacent wall sections disposed at an intersecting angle to each other. Immediately adjacent wall sections are rigidly joined together in abutment along a common vertical joint. An earth anchor is anchored into the ground at each vertical joint. Each joint is secured to the corresponding earth anchor so that downwardly directed hold-down forces are applied by the earth anchors to the wall at the bottom portions of the joints.

U.S. Pat. No. 4,605,090 to Melfi discloses a post and panel type noise barrier fence formed of a plurality of concrete vertical posts or columns which have grooves to hold flat concrete panels between successive ones of the columns. The panels can have a stepped lower edge to accommodate elevational changes in the terrain. Also, certain of the columns have oppositely disposed recesses angled from each other so as to accommodate directional changes at the columns in the direction of the barrier fence.

U.S. Pat. No. 4,607,466 to Allred discloses an acoustic panel having a porous layer and a generally rigid layer affixed to each other. The generally rigid layer includes at least one passageway opening on one side of the rigid layer and extending through the rigid layer to the porous layer. The porous layer is a fibrous material. The rigid layer is a concrete-type material, such as vermiculite-cement plaster. This acoustic panel further comprises a generally rigid planar surface positioned adjacent to the porous layer. This generally rigid planar surface can comprise an insulating layer affixed to the other side of the porous layer and a structural layer fastened to the insulating layer. The insulating layer is a polyurethane foam board. The structural layer is a particle board.

U.S. Pat. No. 4,805,734 to Mast discloses an acoustic wall for streets and parks and for garden-like designs consisting of several substantially U-shaped frame members arranged at a distance from one another, which frame members are connected among one another and have mats applied on their front and side surfaces. In order to substantially reduce the manufacture on location, the duration of setting up and the greening time on location, the acoustic wall consists of individual elements of which each has several U-shaped frame members which are secured at the ends of their long legs on a base. The base forms a rigid frame with fastening means for a lift for the lifting and transporting of the acoustic wall. One or several narrow-mesh mats are secured on the base, which mats prevent a falling out of material filled into the acoustic wall during transport.

U.S. Pat. No. 4,834,213 to Yamamoto et al. discloses a noise silencer for highways adapted to be stuffed in a joint gap formed in a highway. It has a rectangular casing and padding enclosed in the casing. The casing is provided with a vent hole adapted to be closed by a plug. Before mounting the noise silencer, air is firstly sucked out from the silencer through the vent hole to flatten the padding and the vent hole is plugged. After the silencer has been mounted, the vent hole is open to inflate the padding so that the silencer will be pressed against the opposite walls of the joint gap.

U.S. Pat. No. 5,217,771 to Schmanski et al. discloses a device for preventing the transmission of sound, the device being fabricated of polymer composition and comprising a hollow core member formed of fiber-reinforced thermosetting resin, and at least an outer member formed of unreinforced thermoplastic resin which is friction fit to the core member. The core member and outer members are preferably formed by pultrusion and extrusion, respectively. Adjacently disposed devices are connected together to form a fence-like barrier through which few or no sound waves are allowed to pass. This system is advantageously used to prevent sound waves emanating from a large transportation structure such as a highway, railroad track, or airport.

U.S. Pat. No. 5,272,284 to Schmanski discloses a sound wall for placement along a roadside for reducing the transmission of sound from a traffic area wherein the sound wall comprises a plurality of stiff, resilient containment members respectfully configured with the channel configuration and having an enclosed channel volume and continuous open side. Each channel volume is filled with a composite composition of rubber chips and binder compressed within the channel and substantially filling the channel volume. These containment members are stacked in nesting relationship to form a wall structure, with the open side being oriented toward the traffic area.

In my prior invention set forth in U.S. Pat. No. 7,063,184, I disclosed an apparatus and method of making an improved sound reducing panel suitable for use in an outdoor or a hazardous environment. The improved sound reducing panel comprises a water resistant sound absorbing member with a porous covering sheet overlaying a face surface of the sound absorbing member. A support frame is disposed about an outer perimeter of the sound absorbing member. An attachment secures the improved sound reducing panel to the support frame. In one embodiment, a sound blocking member is located adjacent to the sound absorbing member.

In another prior invention set forth in U.S. Pat. No. 7,503,428, I disclosed an apparatus and method for an improved acoustic panel comprising a sound absorbing member defined by a first and second face surface and a plurality of peripheral edges. A sound blocking member is defined by a first and second face surface and a plurality of peripheral edge. The first face surface of the sound blocking member is secured relative to the second face surface of the sound absorbing member for blocking the transmission of sound therethrough. In another embodiment, the first face surface of the sound blocking member is spaced relative to the second face surface of the sound absorbing member for decoupling the sound blocking member from the sound absorbing member.

In still further prior invention set forth in U.S. Pat. No. 8,739,924, I disclosed an apparatus and method for an improved acoustic panel comprising a sound absorbing member defined by a first and second face surface and a plurality of peripheral edges. A sound blocking member is defined by a first and second face surface and a plurality of peripheral edge. The first face surface of the sound blocking member is secured relative to the second face surface of the sound absorbing member for blocking the transmission of sound therethrough. In another embodiment, the first face surface of the sound blocking member is spaced relative to the second face surface of the sound absorbing member for decoupling the sound blocking member from the sound absorbing member.

In my prior invention set forth in U.S. patent application Ser. No. 15/620,944 filed Jun. 13, 2017 entitled Mobile Carriage For Acoustic Panels, I disclosed a carriage for moveably supporting acoustical panels including the acoustical panels set forth in my prior United States Patents.

In my prior invention set forth in U.S. patent application Ser. No. 15/338,240 filed Oct. 28, 2016 entitled Portable Acoustic Blocking System, I disclosed a portable acoustical blocking system comprising a sheet of flexible acoustical blocking material for hanging on a support for inhibiting the flow of acoustic energy between the first and second sides of the acoustical blocking material.

In my prior invention set forth in U.S. patent application Ser. No. 16/033,774 filed Jul. 12, 2018 entitled Portable Decorative Acoustic Blocking System, I disclosed a decorative version of the portable acoustical blocking system set forth in U.S. patent application Ser. No. 15/338,240.

It is an object of the present invention to continue to improve upon my prior inventions by providing a mobile acoustical panel incorporating a sheet of flexible acoustical blocking material.

Another object of this invention is to provide a mobile acoustical panel for facilitating the movement of flexible acoustic panels.

Another object of this invention is to provide a mobile acoustical panel for interlocking a plurality of mobile acoustical panels.

Another object of this invention is to provide a mobile acoustical panel that can be readily transported or stored in a small volume.

Another object of this invention is to provide a mobile acoustical panel that is capable of mounting adjacent acoustic panels at an angle of ninety degrees.

The foregoing has outlined some of the more pertinent objects of the present invention. These objects should be construed as being merely illustrative of some of the more prominent features and applications of the invention. Many other beneficial results can be obtained by modifying the invention within the scope of the invention. Accordingly other objects in a full understanding of the invention may be had by referring to the summary of the invention, the detailed description describing the preferred embodiment in addition to the scope of the invention defined by the claims taken in conjunction with the accompanying drawings.

SUMMARY OF THE INVENTION

The present invention is defined by the appended claims with specific embodiments being shown in the attached drawings. For the purpose of summarizing the invention, the invention relates to a moveable acoustical panel for location on a surface comprising a frame having a lower horizontal support extending between a first and a second end. A first and a second vertical supports extend from the first and second end of the frame. An upper horizontal support extends between the first and the second ends and supports the first and second vertical supports. A first pair of support legs extend angularly from the first end of the frame whereas a second pair of support legs extend angularly from the second end of the frame. A first and second plurality of rolling members are secured to the first and second pair of support legs for enabling the frame to be moved along the surface. A flexible acoustical blocking material is provided for blocking acoustical sound. A plurality of fasteners securing the flexible acoustical blocking material to the supports forming the acoustical panel for inhibiting acoustic transmission therethough.

In a more specific example of the invention, the first and second vertical supports are removably secured to the first and a second end of the frame and the upper horizontal support are removably secured to the first and second end of the first and second vertical supports. Preferably, the first pair of support legs extends from a first end of the frame and forms an angle of forty-five degrees with the frame. Similarly, the second pair of support legs extends from a second end of the frame and forms an angle of forty-five degrees with the frame for enabling the carriage to be orientated with a second carriage at an angle of ninety degrees.

A first and a second arm extend from the first and second support legs and are secured to the first and second vertical supports for stabilizing the supports. The first and second plurality of rolling members include casters secured to the first and second pair of support legs for enabling the moveable acoustical panel to be moved along the surface.

In another specific example of the invention, a second flexible acoustical blocking material depends from the frame for occupying the gap between the frame and the surface.

Preferably, the sheet of acoustical blocking material has a thickness of approximately one-eighth of an inch and a density of greater than one pound per square foot. The sheet of acoustical blocking material comprises a sheet of flexible barium free formulation mineral filled to have a weight greater than one pound per square foot.

The sheet of acoustical blocking material has a first and a second side and bound by material edge. A flexible reinforcing tape permanently affixed to the first side of the sheet of acoustical blocking material adjacent to the material edge. The sheet of acoustical blocking material and the reinforcing tape are flexible for enabling the entire acoustical blocking material including the sheet of acoustical blocking material and reinforcing tape to be rolled as a single unit for transportation. The plurality of fasteners extend through the reinforcing tape and the sheet of acoustical blocking material for securing the flexible acoustical blocking material to the supports for inhibiting the flow of acoustic energy between the first and second sides of the acoustical blocking material.

The foregoing has outlined rather broadly the more pertinent and important features of the present invention in order that the detailed description that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be made to the following detailed description taken in connection with the accompanying drawings in which.

Similar reference characters refer to similar parts throughout the several Figures of the drawings.

DETAILED DISCUSSION

Figure 2:
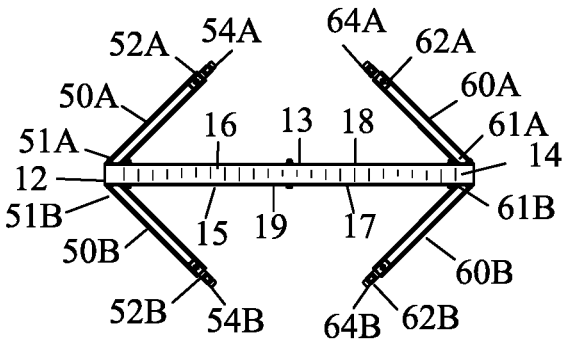
FIG. 2 is a top view of FIG. 1.

FIGS. 1-7 illustrate an improved carrier 5 for moving an acoustical blocking panel 6 on a surface 8. The improved carrier 5 facilitates the movement of large vertical acoustic panels 8 and for arranging a plurality of acoustical panels 6 in an interconnected and interlocking configuration. The improved carrier 5 comprises a frame 20 extending between a first end 21 and a second end 22.

Figure 1:
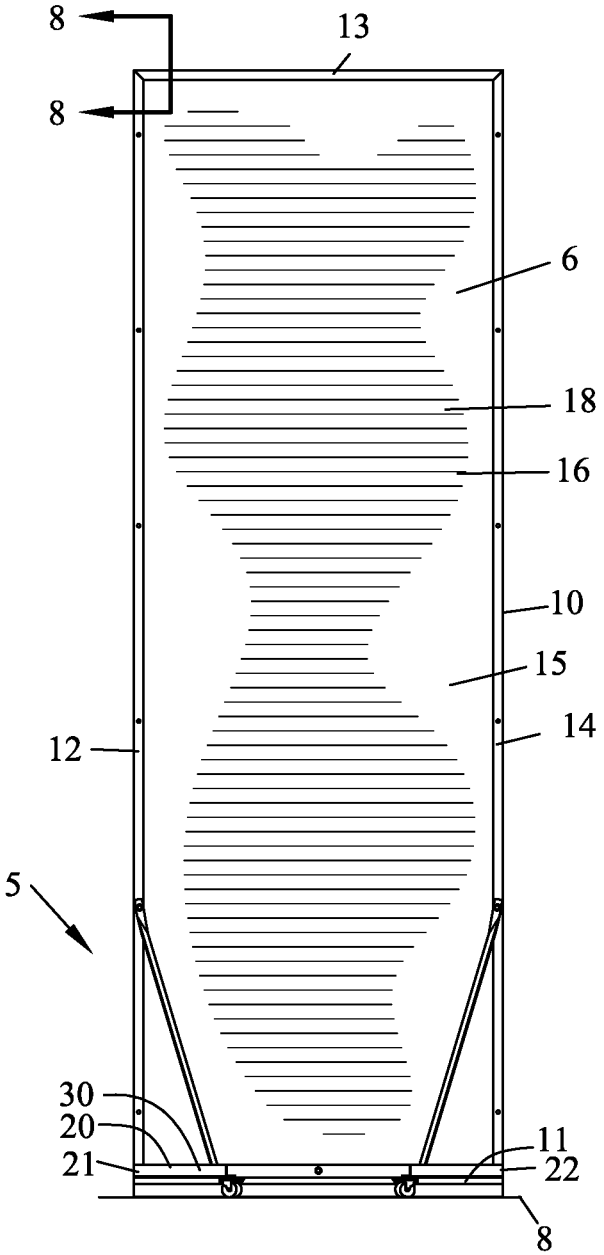
FIG. 1 is a front view of the mobile carriage of the present invention supporting an acoustic panel.
Figure 3:
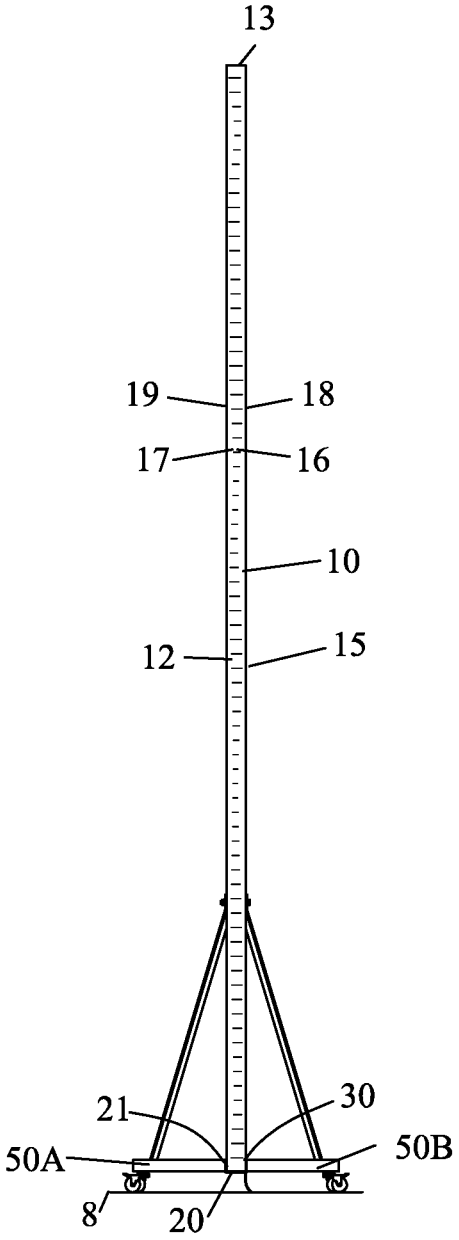
FIG. 3 is a left side view of FIG. 1.
Figure 8:
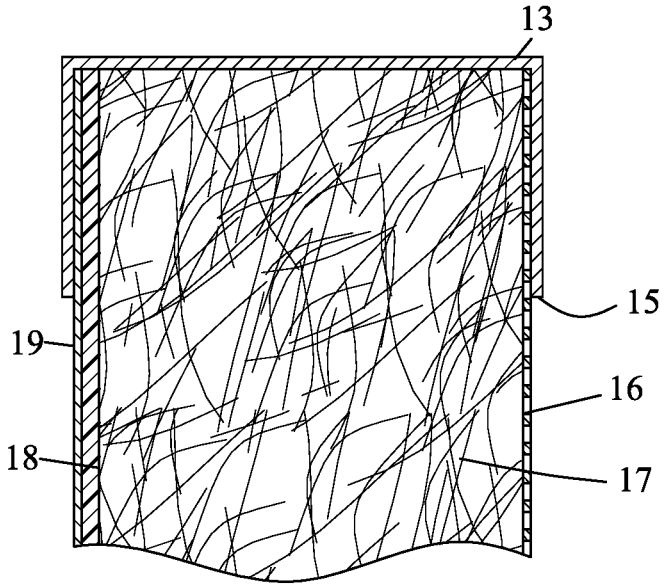
FIG. 8 is a magnified view along line 8-8 in FIG. 1.

FIG. 8 is a magnified sectional view along line 8-8 in FIG. 1 illustrating an example of an acoustical panel 6. The acoustical panel 6 include a peripheral frame 10 defined by first through fourth frame elements 11-14 defining an acoustical aperture 15. The acoustical panel 6 has a sound absorbing member 16 and a sound blocking member 17. Preferably, the sound absorbing member 16 and the sound blocking member 17 are enclosed by a porous screen 18 and a solid sheet 19. A fuller disclosure of a suitable acoustical panel 6 for of use with improved carrier 5 of the present invention are set forth in my prior U.S. Pat. Nos. 7,063,184, 7,503,428, 7,513,082 and 8,739,924 which are incorporated by reference as if fully set forth herein. Although the improved carrier of the present invention has been set forth with reference to a particular type of acoustical panel, it should be understood that the present invention is suitable for us with various types of acoustical panels and non-acoustical panels.

Figure 9:
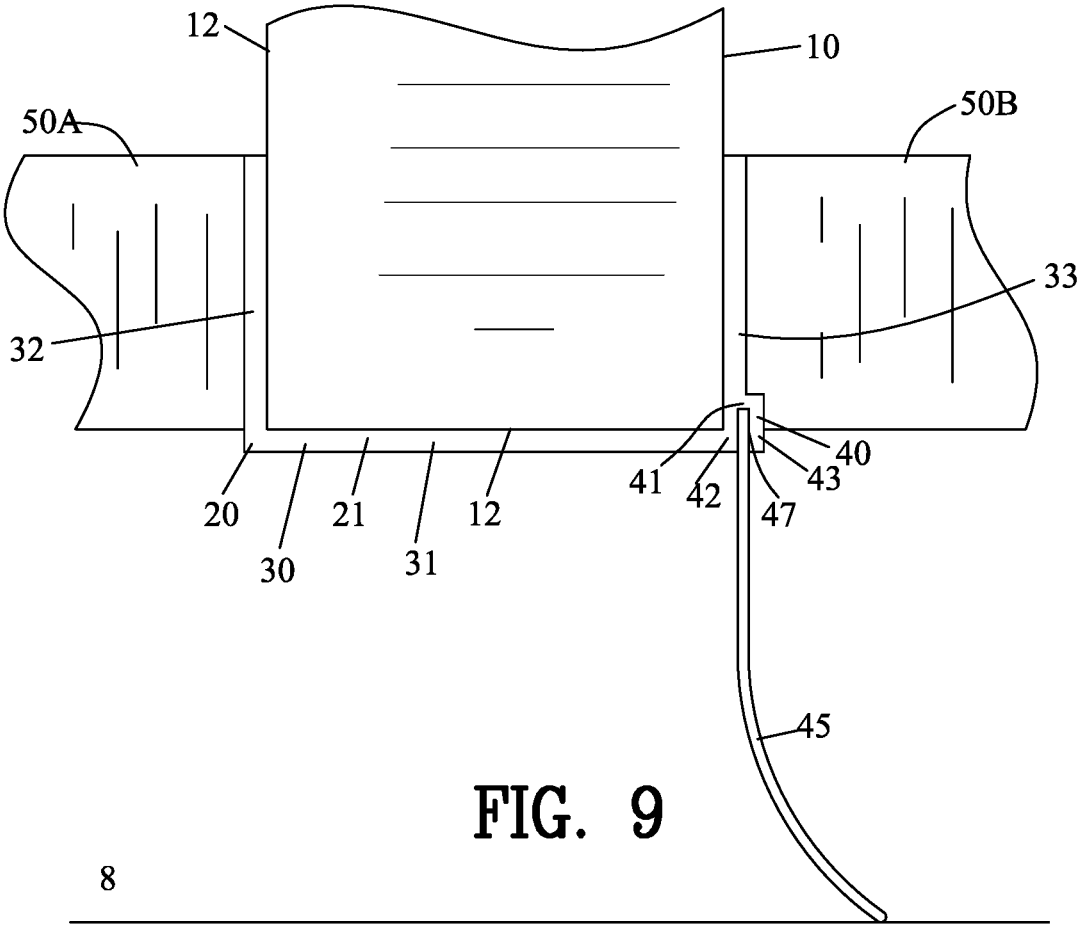
FIG. 9 is a magnified view of a portion of FIG. 6.

FIG. 9 illustrates the frame 20 having a generally U-shaped element 30 formed from a horizontal support 31 and plural vertical supports 32 and 33. The vertical supports 32 and 33 are disposed at opposed ends of the horizontal support 31 thereby defining the generally U-shaped frame element 30.

The generally U-shaped element 30 is upwardly facing and dimensioned to receive the panel frame portion II of the panel frame 10 of the acoustical panel 6. The acoustical panel 6 is secure to the frame 20 in a manner to be described hereinafter.

The frame 20 has a generally U-shaped minor element 40 formed from a horizontal component 41 and plural vertical component 42 and 43. The vertical components 42 and 43 are disposed at opposed ends of the horizontal component 41 thereby defining the generally U-shaped frame element 40. The generally U-shaped element 40 is downwardly facing and dimensioned to receive an acoustical blocking material 45 as will be described in greater detail hereinafter. Preferably, the frame is formed by an extrusion process.

Referring back to FIGS. 1-7, a first pair of legs 50 extend from the first end 21 of the frame 20. The first pair of legs 50 comprises a leg 50A and a leg SOB. The leg 50A extends between a proximal end 51A and a distal end 52A. The proximal end 51A is secured to the first end 21 of the frame 20 by suitable means such as conventional fasteners, welding or the like. The leg SOB extends between a proximal end 51B and a distal end 52B. The proximal end 51B is secured to the first end 21 of the frame 20 by suitable means such as conventional fasteners, welding or the like. Preferably, the conventional fasteners are removable fasteners for shipping in a smaller container.

Rolling members 54A and 54B are secured to the distal end 52A and 52B of the legs 50A and 50B for moving the acoustical panel 6 over the surface 8. Preferably, the rolling members 54A and 54B are casters for facilitating movement of the acoustical panel 6 over the surface 8.

A second pair of legs 60 extends from the second end 22 of the frame 20. The second pair of legs 60 comprises a leg 60A and a leg 60B. The leg 60A extends between a proximal end 61A and a distal end 62A. The proximal end 61A is secured to the second end 22 of the frame 20 by suitable means such as conventional fasteners, welding or the like. The leg 60B extends between a proximal end 61B and a distal end 62B. The proximal end 61B is secured to the first end 61 of the frame 20 by suitable means. Rolling members 64A and 64B are secured to the distal end 62A and 62B of the legs 60A and 60B for moving the acoustical panel 6 over the surface 8. Preferably, the rolling members 64A and 64B are casters for facilitating movement of the acoustical panel 6 over the surface 8.

Figure 5:
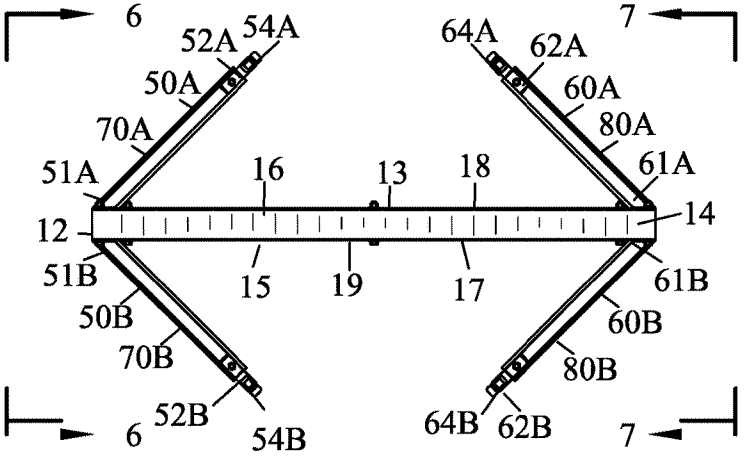
FIG. 5 is a top view of FIG. 4.
Figure 4:
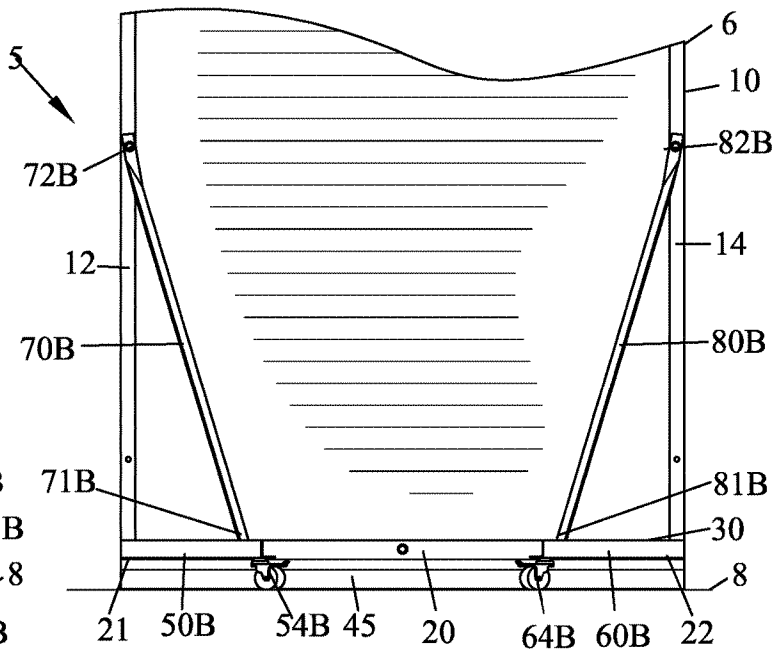
FIG. 4 is a enlarged view of a portion of FIG. 1.
Figure 6:
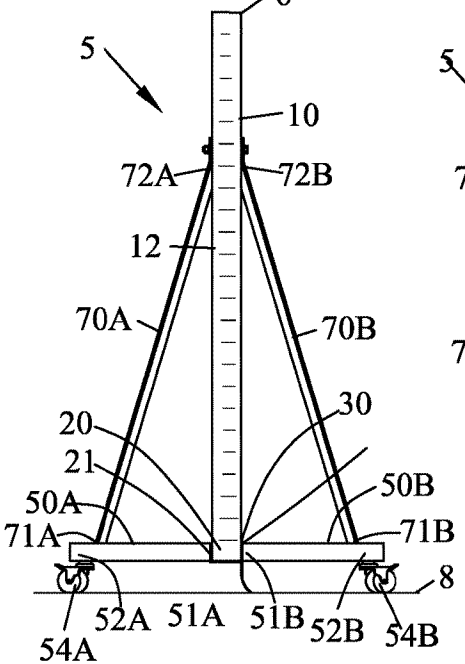
FIG. 6 is a view along line 6-6 in FIG. 5.
Figure 7:
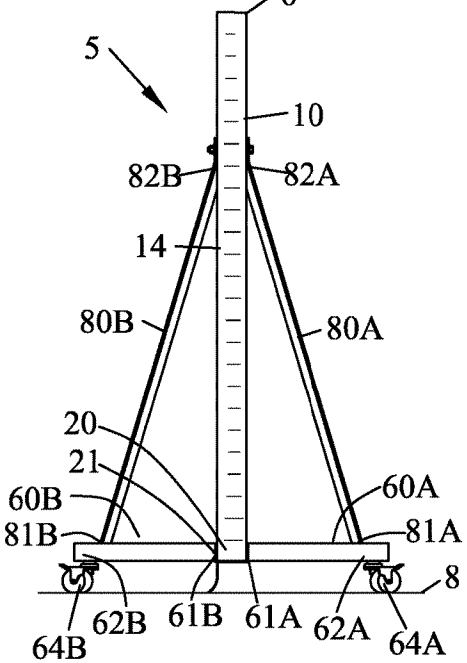
FIG. 7 is a view along line 7-7 in FIG. 5.

As best shown in FIG. 5, the first pair of the support legs 50 extends from the first end 21 of the frame 20 to form an angle of forty-five degrees with said frame 20. The distal ends 52A and 52B of the support legs 50A and SOB extend from the first end 21 of the frame 20 in a direction generally toward the second end 22 of the frame 20.

The second pair of support legs 60 extends from said second end 22 of the frame 20 to form an angle of forty-five degrees with said frame 20. The distal ends 62A and 62B of the support legs 60A and 60B extend from the second end 22 of the frame 20 in a direction generally toward the first end 21 of the frame 20.

A first and second pair of arms 70 and 80 provides support and stabilizes the acoustic panel 6. The first pair of arms 70 comprise arms 70A and 70B is located at the first end 21 of the frame 20 whereas the second pair of arms 80 comprise arms 80A and 80B is located at the second end 21 of the frame 20.

The arm 70A extends between a lower end 71A and an upper end 72A. The lower end 71A is secured to the distal end of the leg 52A by suitable means such as conventional fasteners. The upper end 72A is secured to the second frame element 12 of the peripheral frame 10 of the acoustical panel 6. The arm 70B extends between a lower end 71B and an upper end 72B. The lower end 71B is secured to the distal end of the leg 52B by suitable means such as conventional fasteners. The upper end 72B is secured to the second frame element 12 of the peripheral frame 10 of the acoustical panel 6.

The arm 80A extends between a lower end 81A and an upper end 82A. The lower end 81A is secured to the distal end of the leg 60A by suitable means such as conventional fasteners. The upper end 82A is secured to the fourth frame elements 14 of the peripheral frame 10 of the acoustical panel 6. The arm 80B extends between a lower end 81B and an upper end 82B. The lower end 81B is secured to the distal end of the leg 60B by suitable means such as conventional fasteners. The upper end 82B is secured to the fourth frame element 14 of the peripheral frame 10 of the acoustical panel 6.

Referring back to FIGS. 6 and 9, the rolling members 54A, 54B, 64A and 64B elevate the frame above the surface 8. The sheet of the acoustical blocking material 45 between the frame 20 and the surface 8 inhibits acoustical energy from passing under the improved carrier 5.

The generally U-shaped minor element 40 formed in the frame 20 receives a sheet of the acoustical blocking material 45. The sheet of the acoustical blocking material 45 is retained within the U-shaped minor element 40 by suitable means such as friction, adhesives or the like. Preferably, the sheet of the acoustical blocking material 45 is longer than the distance between the frame 20 and the surface 8 for insuring constant contact of the sheet of the acoustical blocking material 45 with the surface 8.

Figure 11:
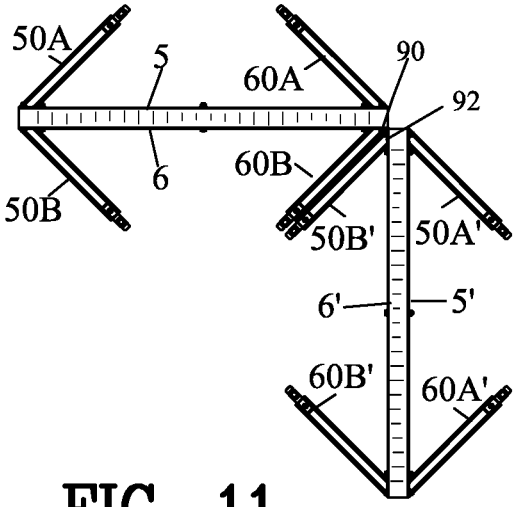
FIG. 11 is a top view of FIG. 10.
Figure 10:
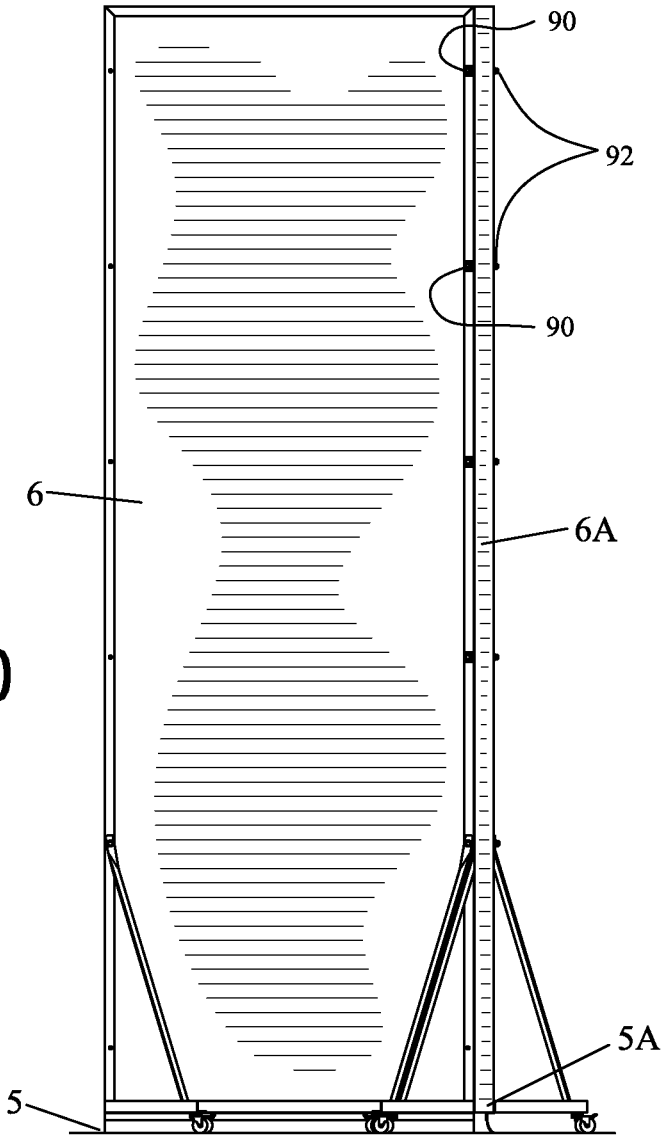
FIG. 10 is a front view illustrating two adjacent mobile carriages interlocking two acoustic panels at an angle of ninety degrees.

FIGS. 10-11 illustrate two adjacent mobile carriages 5 and 5' interlocking two acoustic panels 6 and 6' at an angle of ninety degrees. The forty-five (45°) degree angle of the support legs 50A, SOB, 60A and 60B enable the two adjacent mobile carriages 5 and 5' to be orientated an angle of ninety degrees.

Figure 12:
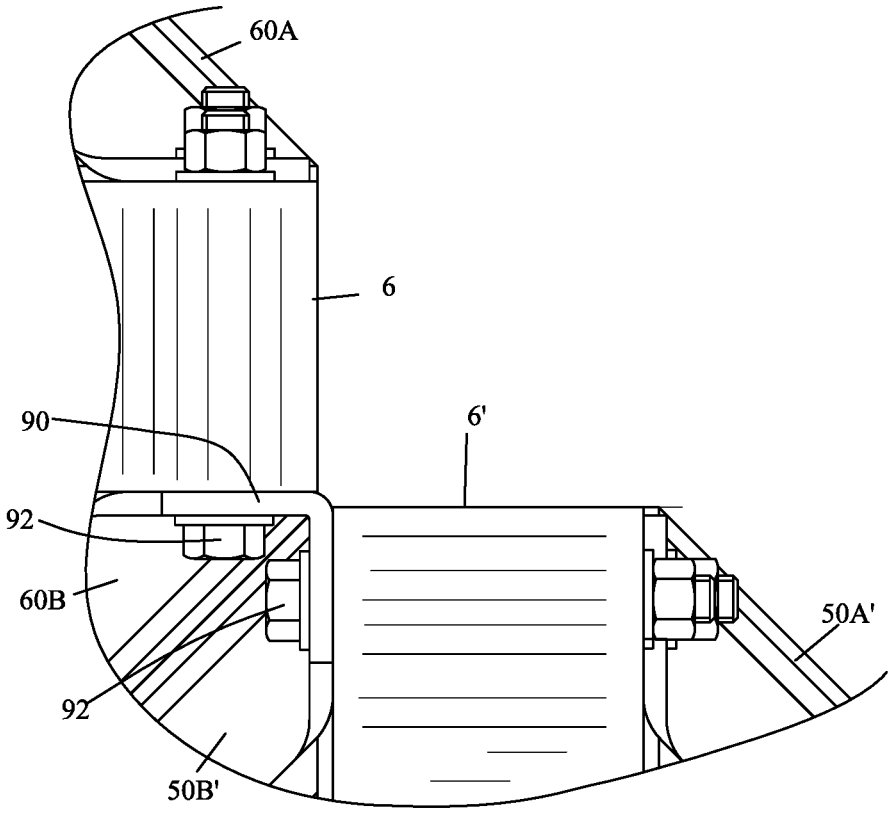
FIG. 12 is a magnified top view of a portion of FIG. 11 illustrating a connector for interlocking two adjacent acoustic panels.
Figure 13:
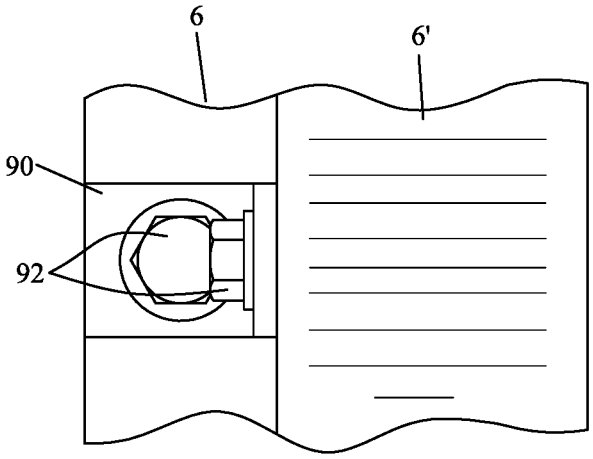
FIG. 13 is a front view of FIG. 12.

FIGS. 12 and 13 illustrate a connector suitable for interlocking the two adjacent acoustic panels 6 and 6'. In this example, a corner coupling 90 is secured to the adjacent acoustic panels 6 and 6' by fasteners 92 shown as bolts. It should be appreciated by those skilled in the art that various types of connectors are suitable for interlocking the two adjacent acoustic panels 6 and 6'

Figure 15:
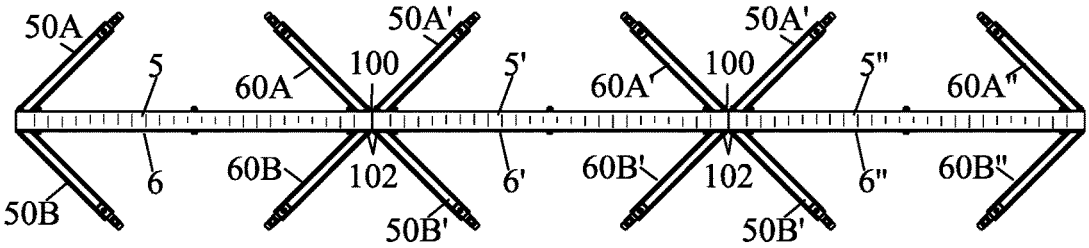
FIG. 15 is a top view of FIG. 14.
Figure 14:
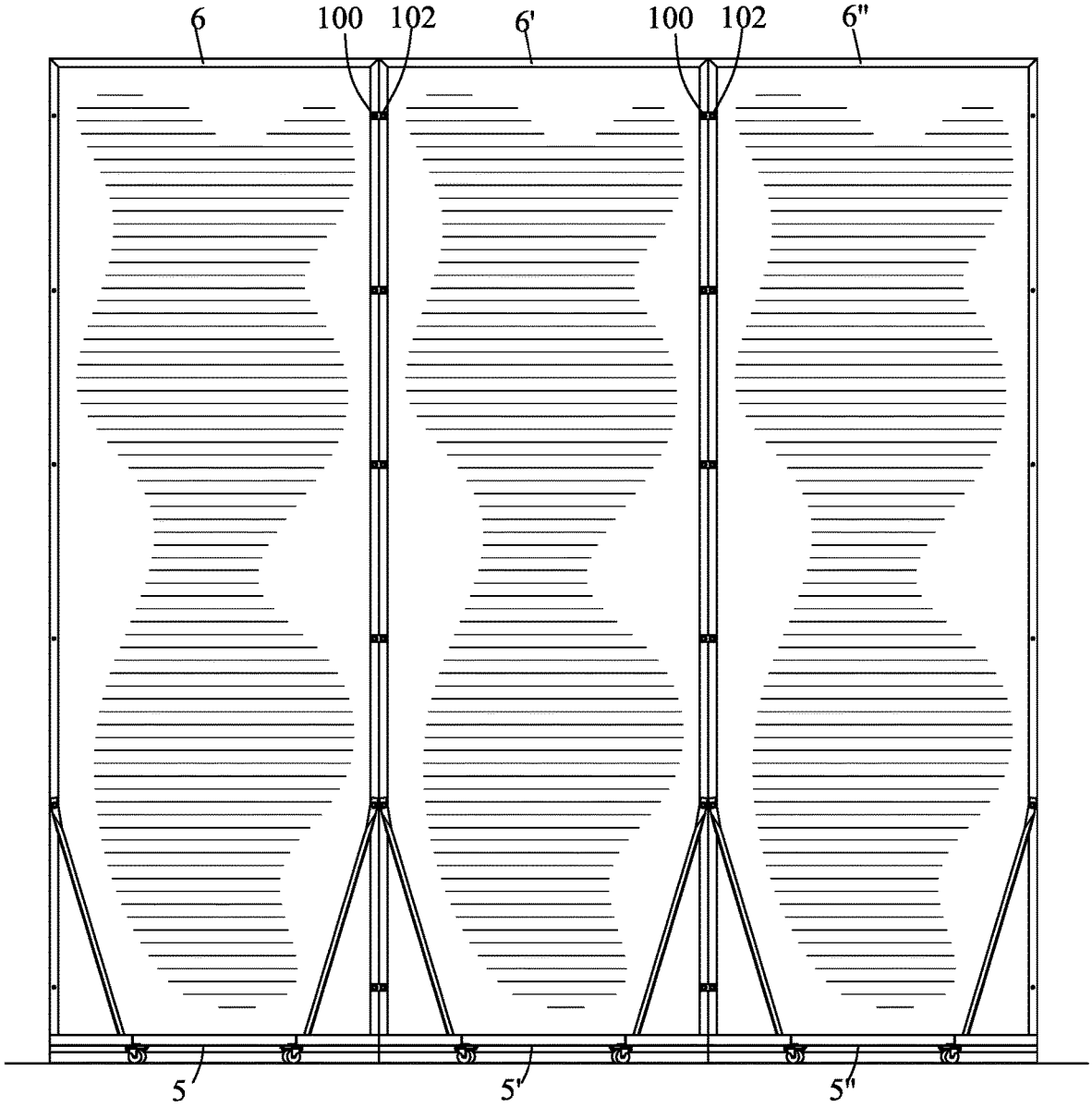
FIG. 14 illustrates three adjacent mobile carriages interlocking three acoustic panels in a linear orientation.

FIGS. 14 and 15 illustrate three adjacent mobile carriages 5, 5' and 5" interlocking three acoustic panels 6, 6' and 6" in a linear orientation. The forty-five (45°) degree angle of the support legs 50A, 50B, 60A and 60B enable the two adjacent mobile carriages 5 and 5' to be orientated in a linear orientation.

Figure 16:
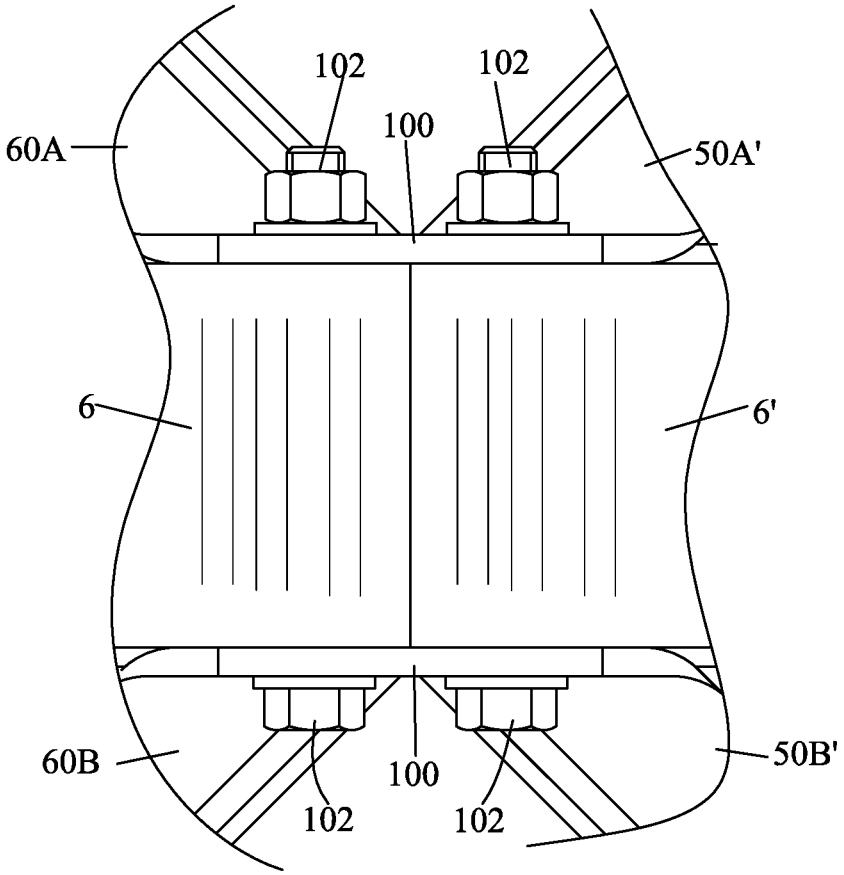
FIG. 16 is a magnified top view of a portion of FIG. 15 illustrating a connector for interlocking two adjacent acoustic panels.
Figure 17:
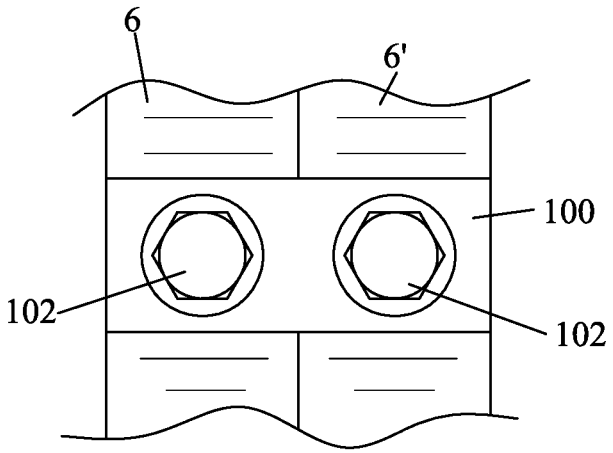
FIG. 17 is a front view of FIG. 16.

FIGS. 16 and 17 illustrate a connector suitable for interlocking the two adjacent acoustic panels 6 and 6'. In this example, a linear coupling 100 is secured to the adjacent acoustic panels 6 and 6' by fasteners 102 shown as bolts. It should be appreciated by those skilled in the art that various types of connectors are suitable for interlocking the two adjacent acoustic panels 6 and 6'

Although the support legs 50A, 50B, 60A and 60B have been shown to be orientated an angle of forty-five (45°) degrees relative to the frame 20, it should appreciated by those skilled in the art that the support legs 50A, 50B, 60A and 60B may be orientated at different acute angles other than forty-five (45°) degrees. Different acute angles will produce acoustical barriers in the shape of pentagon, octagons, and the like.

Figure 19:
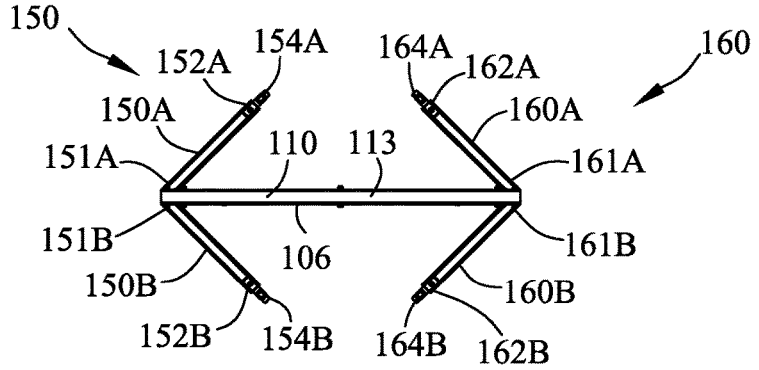
FIG. 19 is a top view of FIG. 18.
Figure 18:
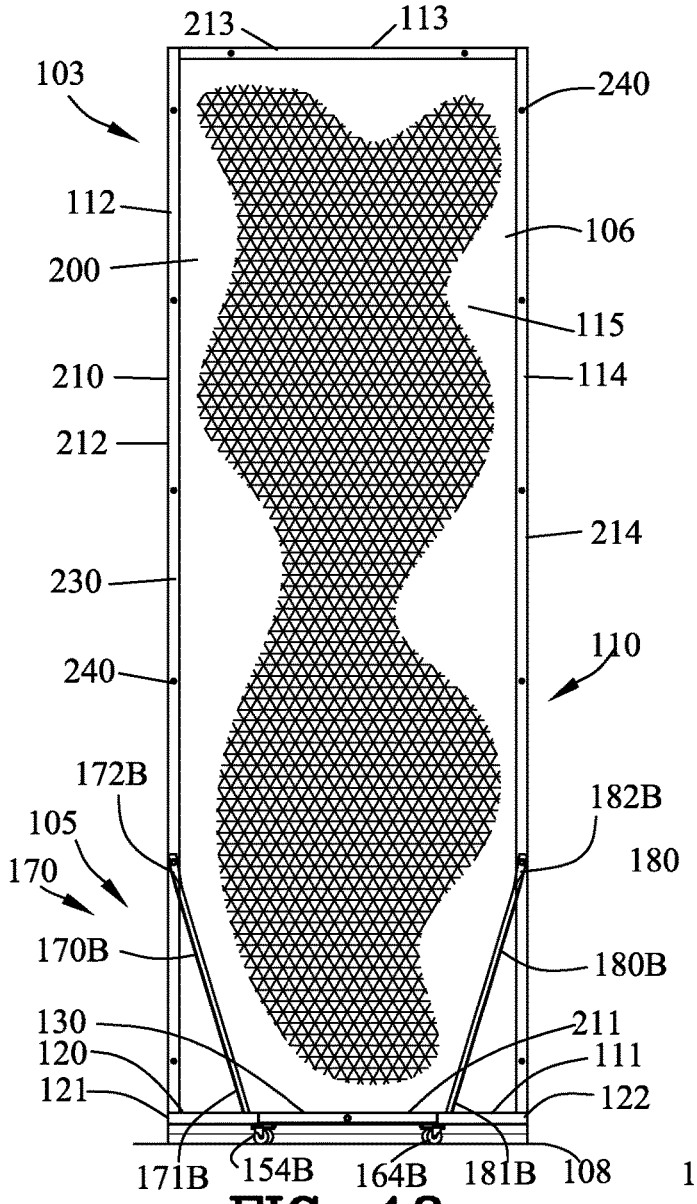
FIG. 18 is a front view of a mobile acoustical panel of the present invention.
Figure 20:
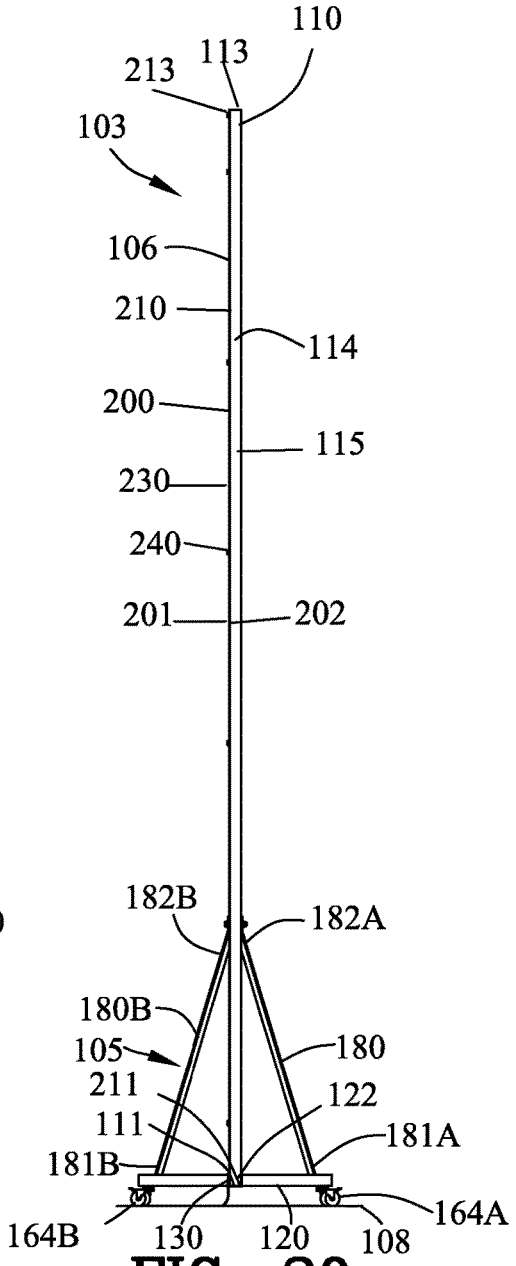
FIG. 20 is a left side view of FIG. 1.

FIGS. 18-20 illustrate a mobile acoustical panel 103 comprising mobile carrier 105 and an acoustical blocking panel 106. The mobile carrier 105 facilitates the movement of a large vertical acoustical blocking panel 106 on a surface 108 and for arranging a plurality of mobile acoustical panels 103 in an interconnected and interlocking configuration.

Figure 28:
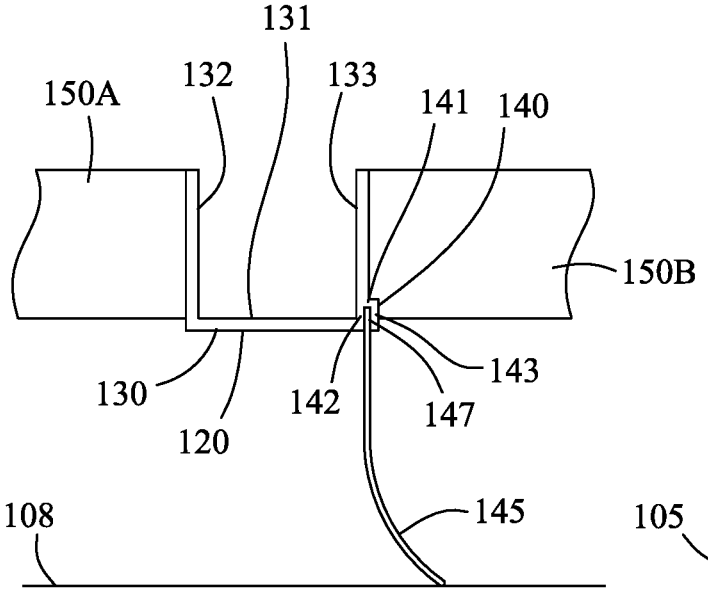
FIG. 28 is an enlarged view of the horizontal support of the mobile carriage.

FIGS. 21-24 are enlarged views illustrating the mobile carrier 105 comprising a frame 120 extending between a first end 121 and a second end 122. As best shown in FIG. 28, the frame 120 is a generally U-shaped element 130 formed from a horizontal support 131 and plural vertical supports 132 and 133. The vertical supports 132 and 133 are disposed at opposed ends of the horizontal support 131 thereby defining the generally U-shaped frame element 130. The generally U-shaped element 130 is upwardly facing and dimensioned to receive the acoustical blocking panel 106. The acoustical panel 106 is secure to the frame 120 in a manner to be described hereinafter.

A first pair of legs 150 extends from the first end 121 of the frame 120. The first pair of legs 150 comprises a leg 150A and a leg 150B. The leg 150A extends between a proximal end 151A and a distal end 152A. The proximal end 151A is secured to the first end 121 of the frame 120 by suitable means such as conventional fasteners, welding or the like. The leg 150B extends between a proximal end 151B and a distal end 152B. The proximal end 151B is secured to the first end 121 of the frame 120 by suitable means such as conventional fasteners, welding or the like. Preferably, the conventional fasteners are removable fasteners for shipping in a smaller container.

Rolling members 154A and 154B are secured to the distal end 152A and 152B of the legs 150A and 150B for moving the mobile carrier 105 over the surface 8. Preferably, the rolling members 154A and 154B are casters for facilitating movement of the mobile carrier 105 over the surface 108.

A second pair of legs 160 extends from the second end 122 of the frame 120. The second pair of legs 160 comprises a leg 160A and a leg 160B. The leg 160A extends between a proximal end 161A and a distal end 162A. The proximal end 161A is secured to the second end 122 of the frame 120 by suitable means such as conventional fasteners, welding or the like. The leg 160B extends between a proximal end 161B and a distal end 162B. The proximal end 161B is secured to the first end 161 of the frame 120 by suitable means. Rolling members 164A and 164B are secured to the distal end 162A and 162B of the legs 160A and 160B for moving the mobile carrier 105 over the surface 108. Preferably, the rolling members 164A and 164B are casters for facilitating movement of the mobile carrier 105 over the surface 108.

Figure 22:
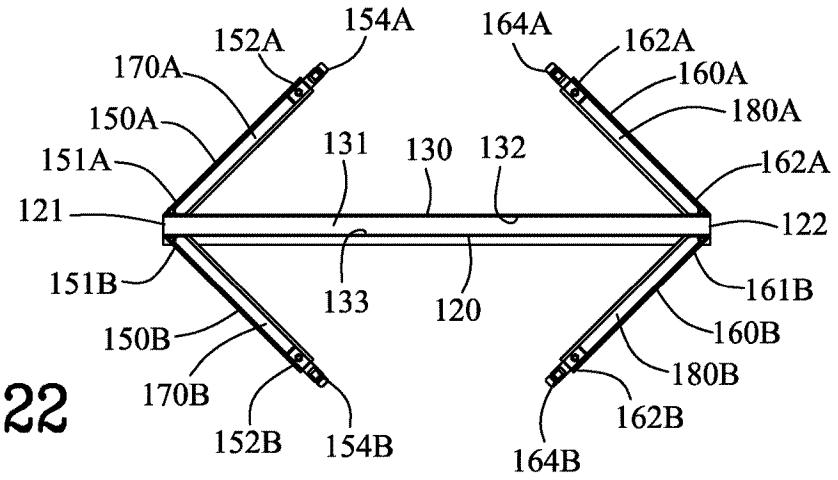
FIG. 22 is a top view of FIG. 21.
Figure 21:
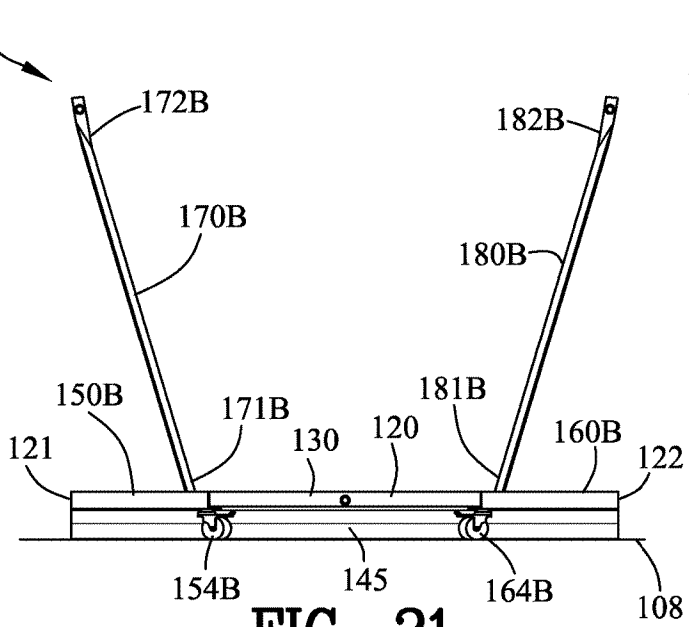
FIG. 21 is an enlarged view of a portion of FIG. 18.
Figure 23:
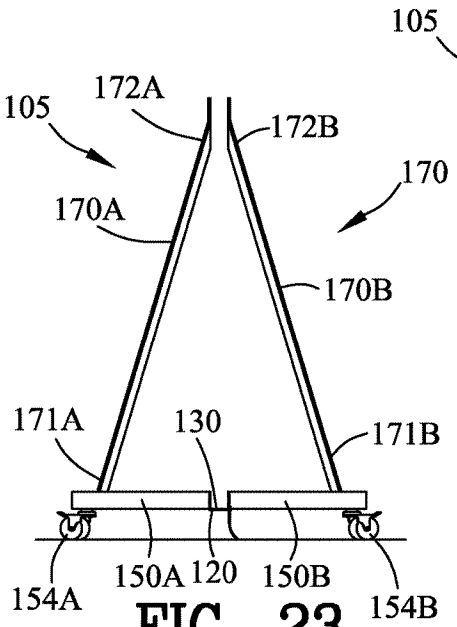
FIG. 23 is a left side view of FIG. 21.
Figure 24:
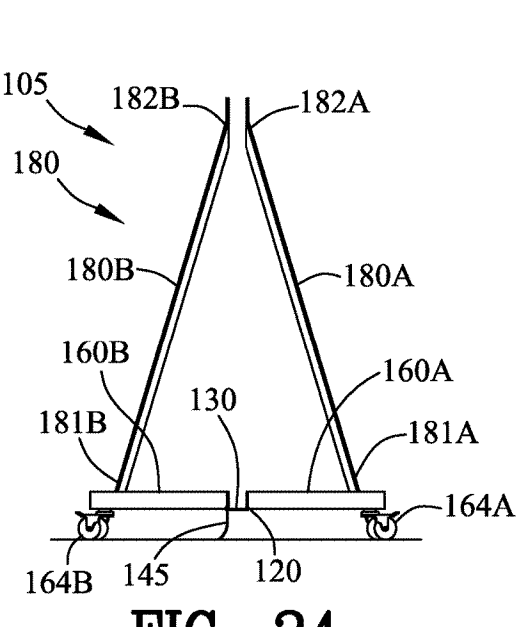
FIG. 24 is a right side view of FIG. 21.

As best shown in FIG. 22, the first pair of the support legs 150 extends from the first end 121 of the frame 120 to form an angle of forty-five degrees with said frame 120. The distal ends 152A and 152B of the support legs 150A and 150B extend from the first end 121 of the frame 120 in a direction generally toward the second end 122 of the frame 120.

The second pair of support legs 160 extends from said second end 122 of the frame 120 to form an angle of forty-five degrees with said frame 120. The distal ends 162A and 1628 of the support legs 160A and 160B extend from the second end 122 of the frame 120 in a direction generally toward the first end 121 of the frame 120.

A first and second pair of arms 170 and 180 provides support and stabilizes the acoustic blocking panel 106. The first pair of arms 170 comprise arms 170A and 1708 is located at the first end 121 of the frame 120 whereas the second pair of arms 180 comprise arms 180A and 180B is located at the second end 121 of the frame 120.

The arm 170A extends between a lower end 171A and an upper end 172A. The lower end 171A is secured to the distal end of the leg 152A by suitable means such as conventional fasteners. The upper end 172A is secured to the panel frame 110 of the acoustical blocking panel 106 which will be described in greater detail hereinafter. The arm 170B extends between a lower end 171B and an upper end 172B. The lower end 171B is secured to the distal end of the leg 152B by suitable means such as conventional fasteners. The upper end 172B is secured to the to the panel frame 110 of the acoustical blocking panel 106.

Similarly, the arm 180A extends between a lower end 181A and an upper end 182A. The lower end 181A is secured to the distal end of the leg 160A by suitable means such as conventional fasteners. The upper end 182A is secured to the panel frame 110 of the acoustical blocking panel 106. The arm 180B extends between a lower end 181B and an upper end 182B. The lower end 181B is secured to the distal end of the leg 160B by suitable means such as conventional fasteners. The upper end 182B is secured to the panel frame 110 of the acoustical blocking panel 106.

Figure 25:
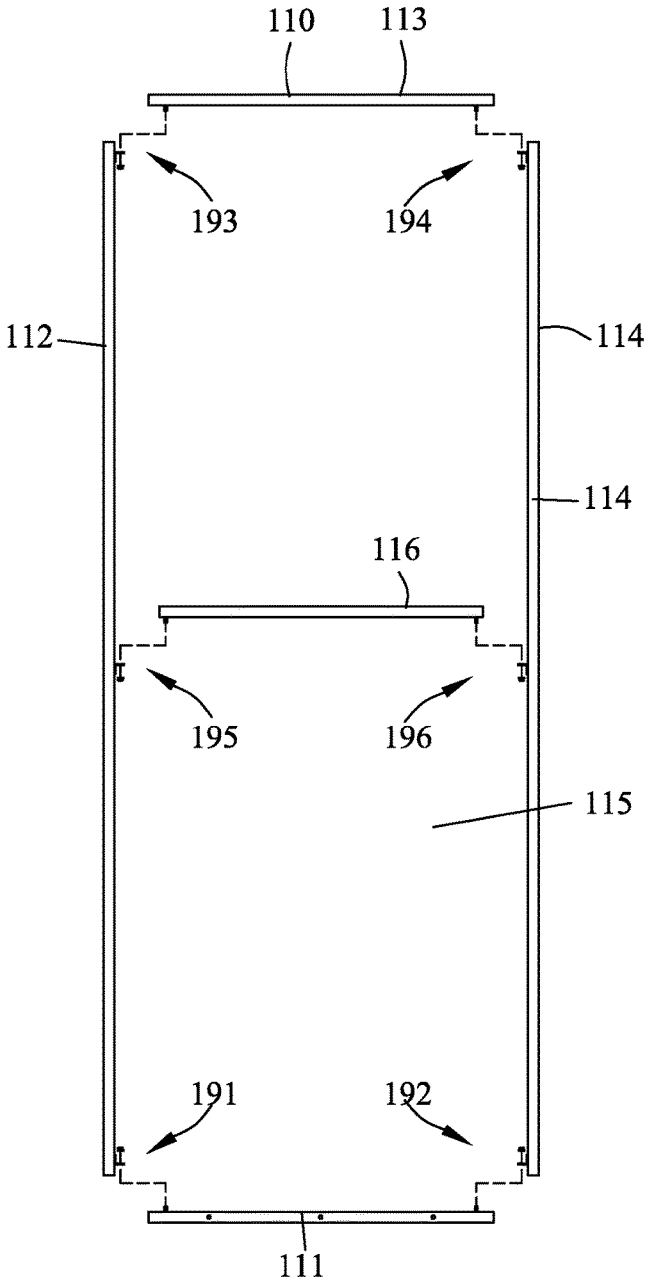
FIG. 25 is a front exploded view of an acoustical panel frame.

FIG. 25 is an exploded view of the acoustical panel frame 110. The acoustical panel frame 110 comprises a lower horizontal panel support 111, a first and second vertical panel support 112 and 113 and an upper horizontal panel support 114. The lower horizontal panel support 111 is assembled to the first and second vertical panel supports 112 and 113 by lower connectors 191 and 192. The upper horizontal panel support 114 is assembled to the first and second vertical panel supports 112 and 113 by upper connectors 193 and 194. An optional intermediate lower horizontal panel support 115 is assembled to the first and second vertical panel supports 112 and 113 by intermediate connectors 195 and 196. The lower connectors 191 and 192, the upper connectors 193 and 194 and the optional intermediate connectors 195 and 196 may be any suitable type of fastener for securing the supports 111-115. The acoustical panel frame 110 defines an open acoustical aperture 116.

Figure 26:
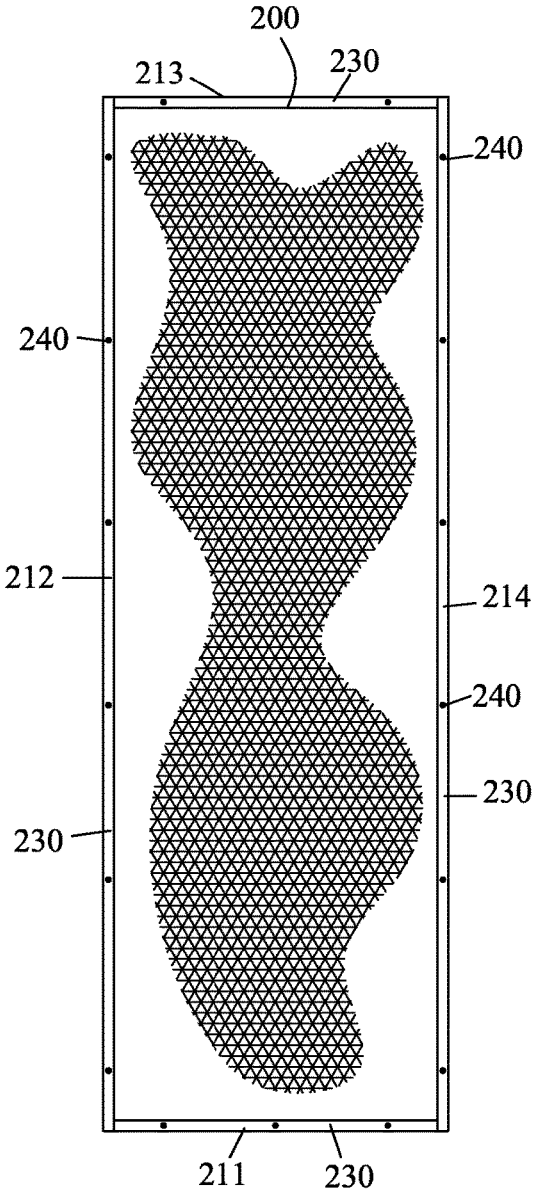
FIG. 26 is a front view of a flexible sound blocking material for the acoustical panel.

FIG. 26 is a front view of the acoustical blocking material 200. The acoustical blocking material 200 has a first side surface 201 and a second side surface 202. The sheet of acoustical blocking material 200 is bound by a material edge 220. In this example, the sheet of acoustical blocking material 200 is bound by a bottom material edge 221, side material edges 222 and 223 and a top material edge 224. The material edges 221-224 define a perimeter of the sheet of acoustical blocking material 200. Although the parameter defined by the material edges 221-224 are shown as a rectangular configuration, it should be understood by those skilled in the art and that the sheet of acoustical blocking material 200 may take various configurations.

In this example, the sheet of acoustical blocking material 200 has a thickness of approximately one-eighth of an inch. The acoustical blocking material 200 comprise a heavy mineral filled, barium free visco elastic acoustical material having a density of greater than one pound per square foot. The sheet of acoustical blocking material 200 is flexible for enabling the sheet of acoustical blocking material 10 to be rolled for transportation and/storage.

A reinforcing tape 230 affixed to the first side 201 of the sheet of acoustical blocking material 10 adjacent to the material edge 220. In this example, reinforcing tapes 231-234 are affixed adjacent to the material edges 221-224 respectively. The reinforcing tape 230 is heat welded to the first side 201 of the sheet of acoustical blocking material 200. In the heat welding process, both the first side 201 of the sheet of acoustical blocking material 200 and the reinforcing tape 230 are simultaneously heated to an appropriated temperature. After the acoustical blocking material 200 and the reinforcing tape 230 are simultaneously are heated to the appropriated temperature, the reinforcing tape 230 is pressed upon the first side 201 of the sheet of acoustical blocking material 200. In one example, the reinforcing tape comprises a woven polyester material but it should be understood that various other materials may be used as a reinforcing tape 230.

Figure 27:
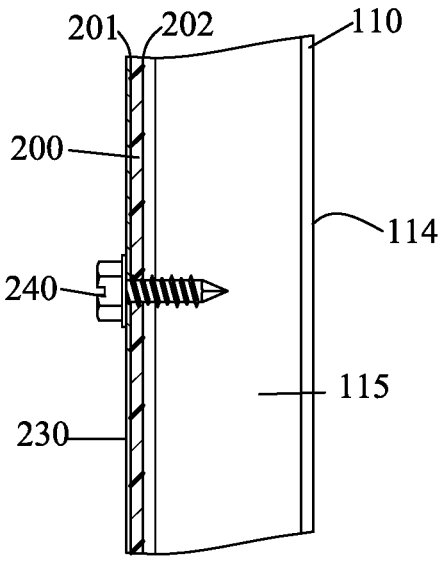
FIG. 27 is an enlarged sectional view of a portion of FIG. 26 illustrating the forming of the acoustical blocking panel by affixing the acoustical blocking material to the acoustical panel frame.

FIG. 27 is an enlarged sectional view of a portion of FIG. 26 illustrating the forming of the acoustical blocking panel 106 by affixing the acoustical blocking material 200 to the acoustical panel frame 110. A plurality of fasteners 240 extend through the reinforcing tape 230 and the sheet of acoustical blocking material 200 into the acoustical panel frame 110. The reinforcing tape 230 provides structural strength to the plurality of fasteners 240 for suspending the sheet of acoustical blocking material 200 on the acoustical panel frame 110.

In this example, the plurality of fasteners 240 are shown as screws but it should be understood by those skilled in the art and that the plurality of fasteners 240 may take various configurations. For example, the fasteners 240 may take the form of adhesives such as conventional adhesives, double back tape, hook and loop fasteners and the like.

FIG. 28 illustrates the generally U-shaped element 130 of the carriage frame 120 formed by horizontal support 131 and plural vertical supports 132 and 133. The vertical supports 132 and 133 are dimensioned to receive the acoustical blocking panel 106.

The rolling members 154A, 154B, 164A and 164B elevate the frame 120 above the surface 108 as previously described with reference to FIGS. 18-24. The sheet of the acoustical blocking material 145 between the frame 120 and the surface 108 inhibits acoustical energy from passing under the mobile carrier 105.

Figure 29:
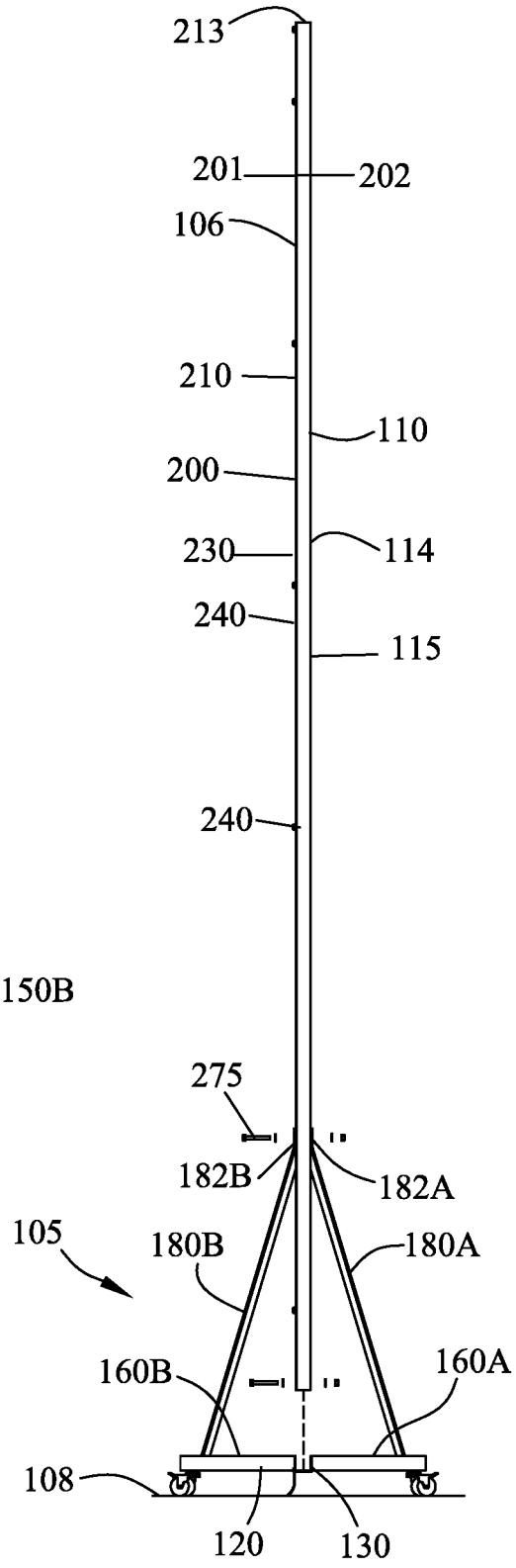
FIG. 29 is a view of the insertion of the acoustical panel into a mobile carriage.

FIG. 29 is a view of the insertion of the acoustical panel into a mobile carriage 105. The lower edge of the acoustical blocking panel 106 is inserted into the generally U-shaped element 130 of the carriage frame 120. Thereafter, the first and second pair of arms 170 and 180 are secured to the panel frame 110 of the acoustical blocking panel 106 by suitable means such as conventional fasteners. The first and second pair of arms 170 and 180 provide support and stabilizes the acoustic blocking panel 106.

Figure 30:
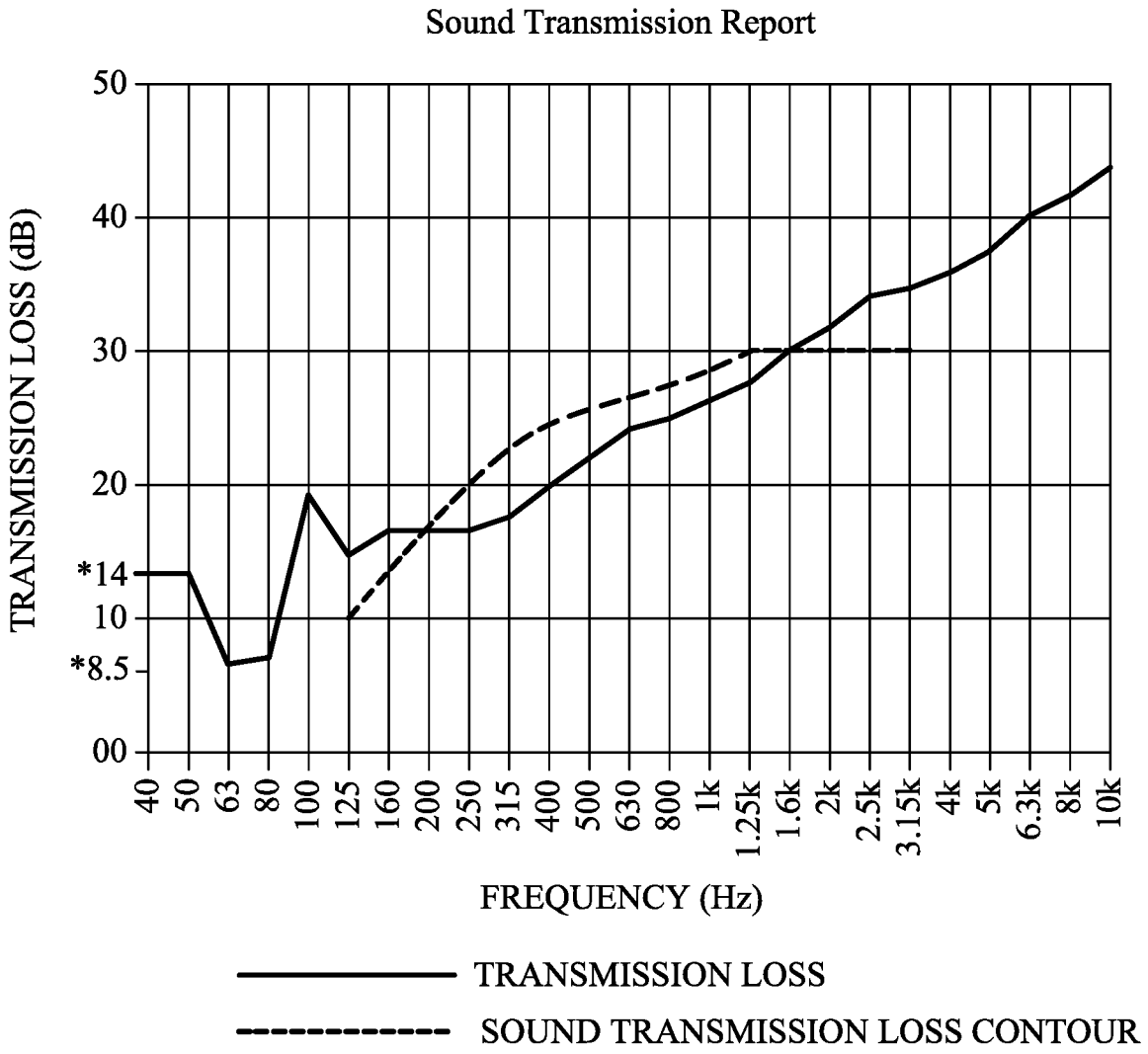
FIG. 30 is a graph of sound transmission loss as a function of frequency for the acoustical blocking panel of the present invention.

FIG. 30 is a graph of sound transmission loss as a function of frequency for the acoustical blocking panel 106 of the present invention. The acoustical blocking panel 106 been tested in independent certified acoustical labs and the sound transmission coefficient (STC) of 28 represents a 85% reduction of sound to the human ear.

Figure 31:
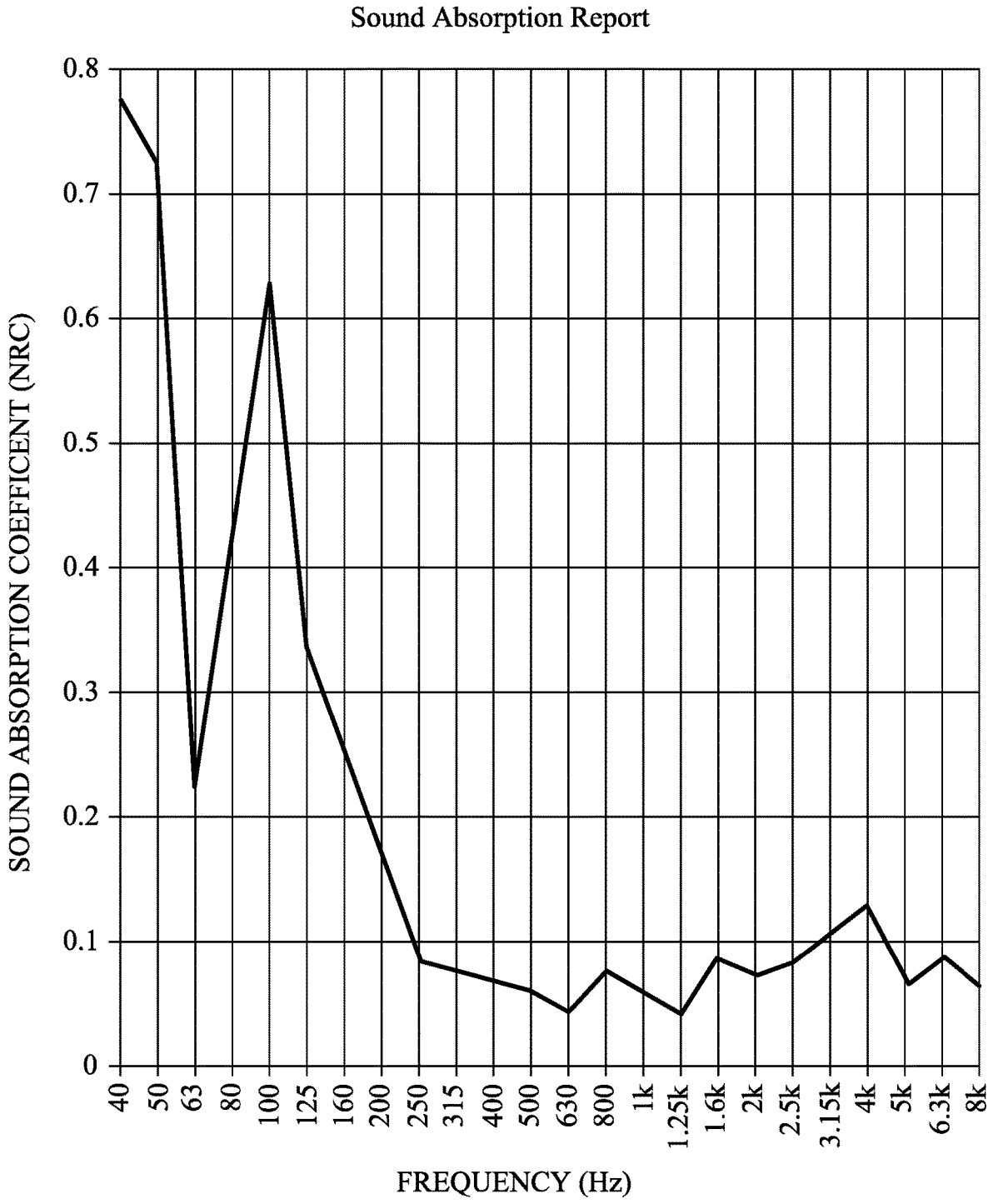
FIG. 31 is a graph of sound absorption as a function of frequency for the acoustical blocking panel of the present invention.

FIG. 31 is a graph of sound absorption as a function of frequency for the acoustical blocking panel 106 of the present invention. In frequencies of 50 Hz and below, the heavy limp acoustical blocking material 10 begins to vibrate from low frequency sound waves. The acoustical blocking material 110 transforms low frequency sound waves into mechanical movement and internal friction energy within the acoustical blocking material 110. Laboratory tests indicate that this transformation process reduces these low frequencies from penetrating the acoustical blocking material 110 by over 60 percent relative to the human ear. In addition the acoustical blocking material 110 becomes as an absorbent material in these frequencies with test results showing in an NRC (noise reduction coefficient) as high as 0.78 (1.00 being the max). The acoustical blocking material 110 not only reduces sound as a barrier, but also acts as an acoustical absorbent material 110 at very low frequencies. Very low frequencies are not reflected as other sound barriers.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. A moveable acoustical panel for location on a surface, comprising:

a frame having a lower horizontal support extending between a first and a second end;

a first and a second vertical supports extending from said first and a second end of said frame;

an upper horizontal support extending between a first and a second end and supported by said first and second vertical supports;

a first pair of support legs extending angularly from opposed sides of said first end of said frame;

a second pair of support legs extending angularly from opposed sides of said second end of said frame;

a first and a second plurality of rolling members secured to said first and second pair of support legs for enabling the moveable acoustical panel to be moved independently along the surface;

a flexible acoustical blocking material for blocking acoustical sound;

a plurality of fasteners securing said flexible acoustical blocking material to said supports;

said first pair of support legs extending from said first end of said frame to form an angle of forty-five degrees with said frame and angled toward said second end of said frame;

said second pair of support legs extend from said second end of said frame to form an angle of forty-five degrees with said frame and angled toward said first end of said frame;

said first and second pair of support legs enabling said frame of the moveable acoustical panel to be orientated with a frame of a second moveable acoustical panel at an angle of ninety degrees whereby one side of said second pair of legs of the moveable acoustical panel being adjacent to one side of a first pair of legs of the second moveable acoustical panel;

a connector for interlocking the moveable acoustical panel with the second moveable acoustical panel at an angle of ninety degrees or a linear orientation; and said connector comprising a coupling for overlying a portion of the moveable acoustical panel and the second moveable panel to interlock the mobile acoustic panels with the second moveable acoustical panel by a removeable fastener.

2. A moveable acoustical panel as set forth in claim 1, wherein said first and second vertical supports are removably secured to said first and a second end of said frame; and said upper horizontal support being removably secured to said first and second end of B said first and second vertical supports.

3. A moveable acoustical panel as set forth in claim 1, including a first and a second arm extending from said first and second support legs and secured to said first and second vertical supports for stabilizing said supports.

4. A moveable acoustical panel as set forth in claim 1, wherein said first and second plurality of rolling members include casters secured to said first and second pair of support legs for enabling the moveable acoustical panel to be move along the surface.

5. A moveable acoustical panel as set forth in claim 1, including a second flexible acoustical blocking material depending from said frame for occupying the gap between said frame and the surface.

6. A moveable acoustical panel as set forth in claim 1, wherein said sheet of acoustical blocking material has a thickness of approximately one-eighth of an inch and a density of greater than one pound per square foot.

7. A moveable acoustical panel as set forth in claim 1, wherein said sheet of acoustical blocking material comprises a sheet of flexible barium free formulation mineral filled to have a weight greater than one pound per square foot.

8. A moveable acoustical panel as set forth in claim 1, wherein said sheet of acoustical blocking material has a first and a second side and bound by material edge;

a flexible reinforcing tape permanently affixed to said first side of said sheet of acoustical blocking material adjacent to said material edge; and said sheet of acoustical blocking material and said reinforcing tape being flexible for enabling the entire acoustical blocking material including said sheet of acoustical blocking material and reinforcing tape to be rolled as a single unit for transportation.

9. A moveable acoustical panel as set forth in claim 1, wherein said sheet of acoustical blocking material having a first and a second side and bound by material edge;

a flexible reinforcing tape permanently affixed to said sheet of acoustical blocking material adjacent to said material edge; and said plurality of fasteners extending through said reinforcing tape and said sheet of acoustical blocking material for securing said flexible acoustical blocking material to said supports for inhibiting the flow of acoustic energy between said first and second sides of the acoustical blocking material.

10. A moveable acoustical panel as set forth in claim 1, including a reinforcing tape comprises a woven polyester material.

11. A moveable acoustical panel as set forth in claim 1, including a reinforcing tape heat welded to said acoustical blocking material.

12. A moveable acoustical panel as set forth in claim 1, wherein said sheet of acoustical blocking material and said reinforcing tape are flexible for enabling said sheet of acoustical blocking material and said reinforcing tape to be rolled for transportation.

13. A moveable acoustical panel for location on a surface comprising:

a frame having a lower horizontal support extending between a first and a second end;

a first and a second vertical supports extending from said first and a second end of said frame;

an upper horizontal support extending between a first and a second end and supported by said first and second vertical supports;

a first pair of support legs extending angularly from opposed sides of said first end of said frame;

a second pair of support legs extending angularly from opposed sides of said second end of said frame;

a first and A second plurality of rolling members secured to said first and second pair of support legs for enabling the moveable acoustical panel to be moved independently along the surface;

a flexible acoustical blocking material;

a flexible reinforcing tape permanently affixed to said sheet of acoustical blocking material adjacent to a material edge;

a plurality of fasteners extending through said flexible reinforcing tape and said flexible acoustical blocking material for securing said flexible acoustical blocking material to said supports;

a first and a second arm extending from said first and second support legs and secured to said first and second vertical supports for stabilizing said flexible acoustical blocking material;

a second flexible acoustical blocking material depending from said frame for occupying the gap between said frame and the surface;

said first pair of support legs extending from said first end of said frame to form an acute angle with said frame and angled toward said second end of said frame;

said second pair of support legs extend from said second end of said frame to form an acute angle with said frame and angled toward said first end of said frame;

said first and second pair of support legs enabling said frame of the moveable acoustical panel to be orientated with a frame of a second moveable acoustical panel at an acute angle whereby one side of said second pair of legs of the moveable acoustical panel being adjacent to one side of a first pair of legs of the second a connector for interlocking the moveable acoustical panel with the second moveable acoustical panel at an acute angle or at a linear orientation; and said connector comprising a coupling for overlying a portion of the moveable acoustical panel and the second moveable panel to interlock the mobile acoustic panel with the second moveable acoustical panel by a removeable fastener.

* * * * *